US011090532B2

(12) United States Patent
Wahl et al.

(10) Patent No.: US 11,090,532 B2
(45) Date of Patent: Aug. 17, 2021

(54) GOLF CLUB HEAD

(71) Applicant: Taylor Made Golf Company, Inc., Carlsbad, CA (US)

(72) Inventors: Bret H. Wahl, Escondido, CA (US); Marni D. Ines, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 16/179,404

(22) Filed: Nov. 2, 2018

(65) Prior Publication Data

US 2019/0070467 A1 Mar. 7, 2019

Related U.S. Application Data

(63) Continuation of application No. 15/831,038, filed on Dec. 4, 2017, now Pat. No. 10,155,143, which is a (Continued)

(51) Int. Cl.
*A63B 53/00* (2015.01)
*A63B 53/04* (2015.01)
(Continued)

(52) U.S. Cl.
CPC ..... *A63B 53/047* (2013.01); *A63B 53/04* (2013.01); *A63B 53/0475* (2013.01); *A63B 60/00* (2015.10); *A63B 60/54* (2015.10); *A63B 69/3635* (2013.01); *A63B 53/042* (2020.08); *A63B 53/045* (2020.08); *A63B 53/0408* (2020.08); *A63B 53/0416* (2020.08); *A63B 53/0454* (2020.08); *A63B 53/0458* (2020.08); (Continued)

(58) Field of Classification Search
USPC ..... 473/350–351, 330–331, 290
See application file for complete search history.

(56) References Cited

U.S. PATENT DOCUMENTS 4,252,262 A 2/1981 Igarashi
5,282,625 A 2/1994 Schmidt et al.
(Continued)

FOREIGN PATENT DOCUMENTS

DE 29715997 9/1997
GB 2249031 4/1992
(Continued)

OTHER PUBLICATIONS

ASM, AISI Type 304 Stainless Steel, uploaded Oct. 18, 2019, ASM webpage, 2 pages.*
(Continued)

*Primary Examiner* — Eugene L Kim
*Assistant Examiner* — Matthew B Stanczak
(74) *Attorney, Agent, or Firm* — Klarquist Sparkman LLP

(57) ABSTRACT

A cavity back iron type club head includes a striking plate having a substantially planar striking surface and a rear surface defining a thickness therebetween. The rear surface defines a striking plate rear cavity region. A perimeter support is coupled to a peripheral portion of the striking plate. The surface area of the striking surface is related to the club head loft angle by the equation SSA≥14.4(L)+2875, where SSA is the surface area of the striking surface in units of square-millimeters and L is the club head loft angle in units of degrees.

18 Claims, 7 Drawing Sheets

Related U.S. Application Data continuation of application No. 14/538,614, filed on Nov. 11, 2014, now abandoned, which is a continuation of application No. 13/971,786, filed on Aug. 20, 2013, now abandoned, which is a continuation of application No. 11/877,580, filed on Oct. 23, 2007, now Pat. No. 8,535,177.

(51) Int. Cl.
*A63B 60/00* (2015.01)
*A63B 60/54* (2015.01)
*A63B 69/36* (2006.01)

(52) U.S. Cl.
CPC ..... *A63B 53/0466* (2013.01); *A63B 53/0487* (2013.01); *A63B 2053/0495* (2013.01); *A63B 2209/00* (2013.01); *A63B 2209/02* (2013.01)

(56) References Cited

U.S. PATENT DOCUMENTS 5,301,946 A 4/1994 Schmidt et al.
5,330,187 A 7/1994 Schmidt et al.
5,333,872 A 8/1994 Manning et al.
5,344,140 A 9/1994 Anderson
5,344,150 A 9/1994 Schmidt et al.
5,505,453 A 4/1996 Mack
5,564,994 A 10/1996 Chang
5,697,855 A 12/1997 Aizawa
5,707,302 A 1/1998 Leon et al.
5,766,092 A 6/1998 Mimeur et al.
5,776,011 A 7/1998 Su et al.
5,830,084 A 11/1998 Kosmatka
5,921,869 A 7/1999 Blough et al.
6,165,081 A 12/2000 Chou
6,290,607 B1 9/2001 Gilbert et al.
6,309,309 B1 10/2001 Beach et al.
6,319,150 B1 * 11/2001 Werner ..... A63B 53/0466 473/349
6,379,262 B1 4/2002 Boone
6,428,426 B1 8/2002 Helmsetter
6,508,722 B1 1/2003 McCabe
6,592,468 B2 7/2003 Vincent et al.
6,616,546 B2 9/2003 Cho
6,652,391 B1 11/2003 Kubica
D490,129 S 5/2004 Greene
6,746,343 B2 6/2004 Yoneyama
6,800,038 B2 10/2004 Willett et al.
6,811,496 B2 11/2004 Wahl et al.
6,899,638 B2 5/2005 Iwata
6,904,663 B2 6/2005 Willett
6,997,820 B2 2/2006 Willett et al.
7,018,303 B2 3/2006 Yamamoto
7,077,763 B2 7/2006 Wahl et al.
7,144,337 B2 12/2006 Hirano
7,150,686 B2 12/2006 Mitsuba
7,153,222 B2 12/2006 Gilbert et al.
7,166,207 B2 1/2007 Chao et al.
7,175,540 B2 2/2007 Sano
7,186,188 B2 * 3/2007 Gilbert ..... A63B 53/047 473/290
7,192,362 B2 * 3/2007 Gilbert ..... A63B 53/00 473/291
D539,862 S 4/2007 Nunez
7,235,023 B2 6/2007 Sugimoto
7,281,991 B2 10/2007 Gilbert et al.
7,591,735 B2 * 9/2009 Matsunaga ..... A63B 53/0475 473/329
7,744,486 B2 6/2010 Hou et al.
7,744,487 B2 6/2010 Tavares et al.
7,922,604 B2 * 4/2011 Roach ..... A63B 60/02 473/350
8,088,025 B2 1/2012 Wahl et al.
8,393,976 B2 3/2013 Soracco
8,449,406 B1 5/2013 Frame et al.
8,920,259 B2 * 12/2014 Takechi ..... A63B 53/047 473/329
8,961,336 B1 2/2015 Parsons et al.
8,974,317 B1 * 3/2015 Griffin ..... A63B 53/0475 473/290
9,878,220 B2 1/2018 Parsons et al.
10,155,143 B2 * 12/2018 Wahl ..... A63B 60/54
2001/0055996 A1 * 12/2001 Iwata ..... A63B 53/04 473/350
2002/0068646 A1 * 6/2002 Yoneyama ..... A63B 53/0466 473/345
2003/0013542 A1 1/2003 Burnett et al.
2003/0036442 A1 2/2003 Chao et al.
2003/0064824 A1 * 4/2003 Takeda ..... A63B 53/047 473/342
2003/0078112 A1 * 4/2003 Sugimoto ..... A63B 53/04 473/342
2003/0092502 A1 5/2003 Pergande et al.
2003/0119602 A1 6/2003 Kennedy et al.
2003/0228928 A1 * 12/2003 Yabu ..... A63B 53/047 473/290
2003/0236134 A1 * 12/2003 Nishitani ..... A63B 53/047 473/349
2004/0043830 A1 * 3/2004 Imamoto ..... A63B 53/047 473/332
2004/0083596 A1 5/2004 Willett et al.
2004/0099538 A1 5/2004 Chao et al.
2004/0242339 A1 * 12/2004 Gilbert ..... A63B 53/047 473/291
2005/0026716 A1 * 2/2005 Wahl ..... A63B 60/02 473/334
2005/0037864 A1 * 2/2005 Gilbert ..... A63B 53/047 473/349
2005/0101406 A1 5/2005 Hirano
2005/0143188 A1 * 6/2005 Tseng ..... A63B 53/04 473/332
2005/0192116 A1 * 9/2005 Imamoto ..... A63B 53/0475 473/329
2005/0202900 A1 * 9/2005 Gilbert ..... A63B 53/047 473/342
2005/0215349 A1 9/2005 Huang et al.
2005/0277484 A1 * 12/2005 Reed ..... A63B 53/047 473/332
2006/0052179 A1 3/2006 Hou
2006/0063606 A1 * 3/2006 Schweigert ..... A63B 53/0466 473/329
2006/0128497 A1 6/2006 Hou et al.
2006/0172822 A1 8/2006 Liang et al.
2006/0199661 A1 9/2006 Deng et al.
2006/0234805 A1 * 10/2006 Gilbert ..... A63B 53/047 473/290
2006/0234806 A1 * 10/2006 Gilbert ..... A63B 60/54 473/291
2006/0234808 A1 * 10/2006 Gilbert ..... A63B 53/0475 473/291
2007/0129162 A1 * 6/2007 Pan ..... A63B 60/54 473/332
2007/0129165 A1 * 6/2007 Matsunaga ..... A63B 53/04 473/345
2007/0129166 A1 * 6/2007 Shimazaki ..... A63B 53/0475 473/345
2007/0129168 A1 * 6/2007 Matsunaga ..... A63B 53/0475 473/349
2007/0155534 A1 7/2007 Tsai et al.
2007/0225086 A1 9/2007 Lin
2007/0287556 A1 12/2007 Nakamura
2008/0015048 A1 1/2008 Gilbert et al.
2008/0032815 A1 * 2/2008 Yamamoto ..... A63B 60/54 473/332
2008/0058119 A1 * 3/2008 Soracco ..... A63B 53/047 473/350
2008/0125246 A1 5/2008 Matsunaga
2009/0062032 A1 * 3/2009 Boyd ..... A63B 53/04 473/338
2009/0118037 A1 * 5/2009 Roach ..... A63B 60/02 473/349

(56) References Cited

U.S. PATENT DOCUMENTS

| | | | | |
|---|---|---|---|---|
| 2009/0137339 | A1* | 5/2009 | Nakano | A63B 53/0475 473/350 |
| 2010/0261540 | A1* | 10/2010 | Roach | A63B 60/00 473/291 |
| 2010/0273570 | A1* | 10/2010 | Ines | B23P 15/00 473/342 |
| 2010/0304887 | A1 | 12/2010 | Bennett et al. | |
| 2013/0281227 | A1* | 10/2013 | Roach | A63B 53/047 473/332 |
| 2018/0085643 | A1* | 3/2018 | Wahl | A63B 60/54 |

FOREIGN PATENT DOCUMENTS

| | | |
|---|---|---|
| JP | H10-127832 | 5/1998 |
| JP | H10-277187 | 10/1998 |
| JP | 2001-346924 | 12/2001 |
| JP | 2004-209091 | 7/2004 |
| JP | 2004-313777 | 11/2004 |
| WO | WO 92/15374 | 9/1992 |

OTHER PUBLICATIONS

BASF, Thermoplastic Polyurethane Elastomers, uploaded Oct. 18, 2019, BASF, 8 pages.*

BASF, Thermoplastic Polyurethane Elastomers, uploaded Oct. 29, 2020, BASF, 8 pages.*

Best Stainless & Alloys, 17-4 PH Stainless Steel Bar, uploaded Aug. 14, 2018, Best Stainless & Alloys, 7 pages.

AZO Materials, AISI 1070 Carbon Steel, uploaded Aug. 14, 2018, AZO Materials, 3 pages.

BASF, Thermoplastic Polyurethan Elastomers, uploaded Jan. 31, 2018, BASF, 8 pages.

TaylorMade Golf Introduces New rac LT Irons, http://www.tmag.com/media/pressreleases/080604_racLT.htm, (accessed Oct. 28, 2004).

Non-final Office action dated Feb. 11, 2013 from U.S. Appl. No. 11/877,580, 18 pp.

Petition for Inter Partes Review, filed Jan. 17, 2018, Case No. IPR2018-00516 for U.S. Pat. No. 8,932,150, for Golf Club Head, owned by Taylor Made Golf Company, Inc.

Petition for Inter Partes Review, filed Jan. 26, 2018, Case No. IPR2018-00540 for U.S. Pat. No. 8,353,785, for Golf Club Head, owned by Taylor Made Golf Company, Inc.

Petition for Inter Partes Review, filed Feb. 21, 2018, Case No. IPR2018-00675 for U.S. Pat. No. 9,199,143, for Golf Club Heads and Methods to Manufacture Golf Club Heads, owned by Parsons Xtreme Golf LLC.

Petition for Inter Partes Review, filed Feb. 26, 2018, Case No. IPR2018-00702 for U.S. Pat. No. 8,961,336, for Golf Club Heads and Methods to Manufacture Golf Club Heads, owned by Parsons Xtreme Golf LLC.

Petition for Inter Partes Review, filed Mar. 12, 2018, Case No. IPR2018-00768 for U.S. Pat. No. 9,345,938, for Golf Club Heads and Methods to Manufacturing Golf Club Heads, owned by Parsons Xtreme Golf LLC.

Petition for Inter Partes Review, filed Mar. 12, 2018, Case No. IPR2018-00769 for U.S. Pat. No. 9,346,203, for Golf Club Heads and Methods to Manufacture Golf Club Heads, owned by Parsons Xtreme Golf LLC.

Petition for Inter Partes Review, filed Mar. 23, 2018, Case No. IPR2018-00826 for U.S. Pat. No. 9,533,201, for Golf Club Heads and Methods to Manufacture Golf Club Heads, owned by Parsons Xtreme Golf LLC.

Petition for Inter Partes Review, filed Apr. 11, 2018, Case No. IPR2018-00891 for U.S. Pat. No. 9,468,821, for Golf Club Heads and Methods to Manufacture Golf Club Heads, owned by Parsons Xtreme Golf LLC.

Petition for Inter Partes Review, filed Apr. 13, 2018, Case No. IPR2018-00915 for U.S. Pat. No. 9,610,481, for Golf Club Heads and Methods to Manufacture Golf Club Heads, owned by Parsons Xtreme Golf Llc.

Petition for Inter Partes Review, filed Apr. 18, 2018, Case No. IPR2018-00925 for U.S. Pat. No. 9,364,727, for Golf Club Heads and Methods to Manufacture Golf Club Heads, owned by Parsons Xtreme Golf LLC.

Petition for Inter Partes Review, filed Apr. 27, 2018, Case No. IPR2018-00983 for U.S. Pat. No. 9,675,853, for Golf Club Heads and Methods to Manufacture Golf Club Heads, owned by Parsons Xtreme Golf LLC.

Petition for Inter Partes Review, filed Aug. 22, 2018, Case No. IPR2018-01542 for U.S. Pat. No. 9,814,952, for Golf Club Heads and Methods to Manufacture Golf Club Heads, owned by Parsons Xtreme Golf LLC.

Petition for Inter Partes Review, filed Sep. 12, 2018, Case No. IPR2018-01681 for U.S. Pat. No. 9,610,481, for Golf Club Heads and Methods to Manufacture Golf Club Heads, owned by Parsons Xtreme Golf LLC.

* cited by examiner

GOLF CLUB HEAD

CROSS REFERENCE TO RELATED APPLICATION

This application is a continuation of U.S. patent application Ser. No. 15/831,038, filed Dec. 4, 2017, which is a continuation of U.S. patent application Ser. No. 14/538,614, filed Nov. 11, 2014, which is a continuation of U.S. patent application Ser. No. 13/971,786, filed Aug. 20, 2013, which is a continuation of U.S. patent application Ser. No. 11/877,580, filed Oct. 23, 2007, now U.S. Pat. No. 8,535,177, which are incorporated herein by reference in their entirety.

TECHNICAL FIELD

The disclosure pertains to iron type golf clubs.

BACKGROUND

The performance of golf equipment is continuously advancing due to the introduction of advanced materials to both golf clubs (irons, woods, and putters) and balls, as well as the development of innovative clubs and club designs such as high loft woods and oversize drivers. While all clubs in the golfer's bag are important, both scratch and novice golfers rely on the performance and feel of their irons for many commonly encountered playing situations.

Irons are generally configured in a set that includes clubs of varying loft, with shaft lengths and clubhead weights selected to maintain an approximately constant "swing weight" so that the golfer perceives a common "feel" or "balance" in swinging both the low irons and high irons in a set. The size of an iron's "sweet spot" is generally related to the size (i.e., surface area) of the iron's striking face, and iron sets are available with oversize club heads to provide a large sweet spot that is desirable to many golfers.

Conventional "blade" type irons have been largely displaced (especially for novice golfers) by so-called "perimeter weighted" irons, which include "cavity-back" and "hollow" iron designs. Cavity-back irons have a cavity directly behind the striking plate, which permits club head mass to be distributed about the perimeter of the striking plate, and such clubs tend to be more forgiving to off-center hits. Hollow irons have features similar to cavity-back irons, but the cavity is enclosed by a rear wall to form a hollow region behind the striking plate. Perimeter weighted, cavity back, and hollow iron designs permit club designers to redistribute club head mass to achieve intended playing characteristics associated with, for example, placement of club head center of mass or a moment of inertia.

While perimeter-weighted designs offer more design possibilities than blade type designs, perimeter weighting can result in clubs with an undesirable "feel." In addition, even with perimeter weighting, significant portions of club head mass, such as the mass associated with the striking plate, are unavailable for redistribution. Additional design flexibility is needed for improved club heads and clubs.

SUMMARY

A cavity back iron type club head includes a striking plate having a substantially planar striking surface and a rear surface defining a thickness therebetween. The rear surface defines a striking plate rear cavity region. A perimeter support is coupled to a peripheral portion of the striking plate. The surface area of the striking surface is related to the club head loft angle by the equation SSA≥14.4(L)+2875, where SSA is the surface area of the striking surface in units of square-millimeters and L is a club head loft angle in units of degrees.

In alternative examples, the cavity back iron type club head may include an unsupported striking plate area defined as the portion of the striking plate rear cavity region lacking a backing support structure having a modulus of elasticity greater than about 25 GPa. An unsupported area ratio defined as a ratio of the unsupported striking plate area and the surface area of the striking surface may be used to characterize the club head. In some examples, the unsupported area ratio is greater than or equal to 80%.

In yet other alternative examples, the striking plate thickness and the unsupported striking plate area may be associated with a characteristic thickness ratio defined as a ratio of the average striking plate thickness within the striking plate rear cavity region and a square root of the unsupported striking plate area. In some examples, the characteristic thickness ratio is less than about 5%.

DETAILED DESCRIPTION

Figure 1:
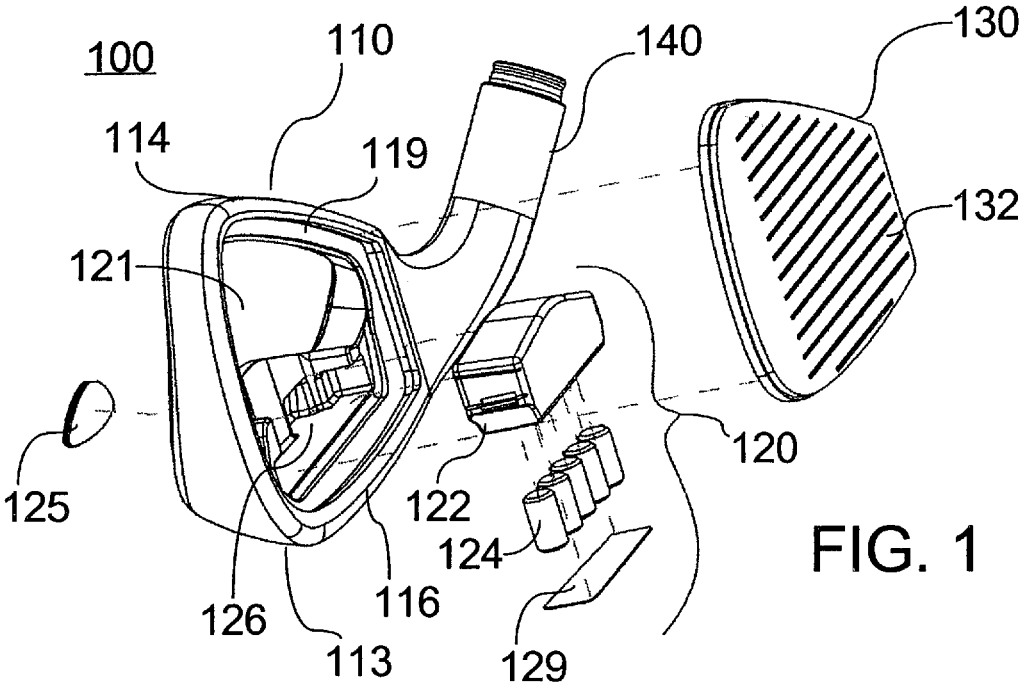
FIG. 1 is an exploded view of a representative club head for an iron type golf club.
Figure 2:
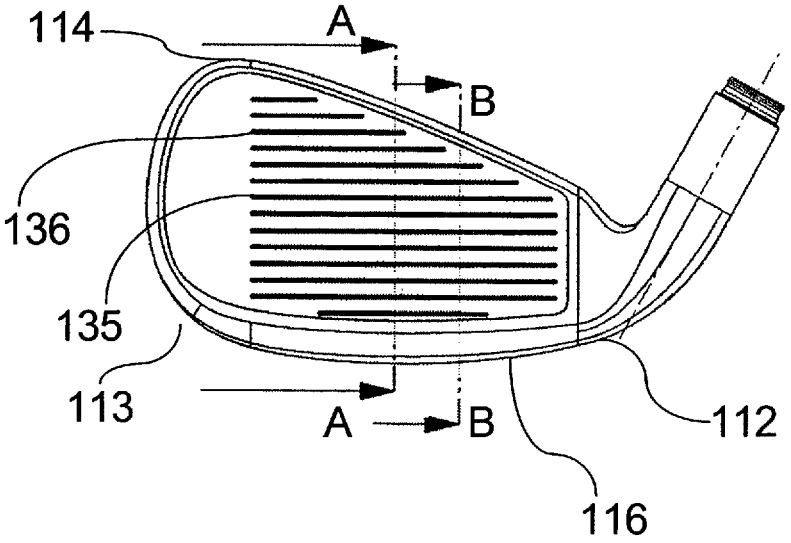
FIG. 2 is an elevational view of the representative club head of FIG. 1.

Referring to FIGS. 1-4, an iron-type club head 100 includes a head body 110, a cartridge assembly 120, and a striking plate 130. The head body 110 includes a heel 112, a toe 113, a top line 114, a sole 116, and a hosel 140 configured to attach the club head 100 to a shaft (not shown in FIGS. 1-4). The head body 110 defines a front opening 121 configured to receive the striking plate 130 at a front rim 119 formed around a periphery of the front opening 121. Club head mass may be distributed about the perimeter of the club body 110 based on a particular mass distribution for the club head 100 selected by a club head designer. Perimeter weighting can take various forms. Typical designs include a sole bar or other mass at or near the club head sole 116 to provide a center of gravity that is situated low in the club head 100 and behind the striking plate 130 as viewed from a striking surface 132 of the club head.

Figure 3:
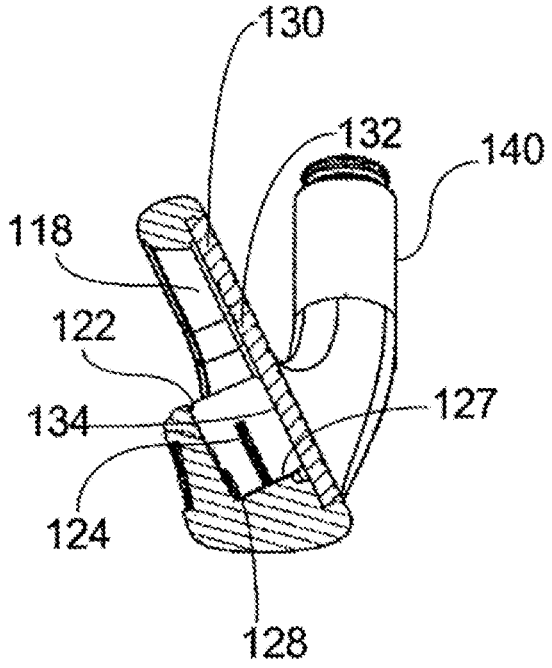
FIG. 3 is a partial sectional view of the golf club head of FIG. 1 illustrating a cartridge insert in contact with a rear surface of a striking plate.

As shown in FIG. 1, the striking plate 130 and the head body 110 may be formed separately. In such a design, the completed club head 100 is made by placing the striking plate 130 in the front opening 121 and in contact with the front rim 119. The striking plate 130 is then welded or otherwise secured to the heady body 110, thereby forming a cavity 118 behind a rear surface 134 of the striking plate 130. When secured to the head body 110, the striking plate 130 is supported at or by the front rim 119. As defined herein, the striking surface 132 is a substantially planar surface configured to strike a golf ball. As shown in FIG. 3, where the striking plate 130 and the head body 110 are formed separately, the striking surface 132 may be defined by both the striking plate and at least a portion of the front rim 119 of the head body if the substantially planar striking surface extends beyond the periphery of the striking plate.

Grinding and/or polishing operations can be used to remove any excess material or irregularities introduced in the welding process, or to provide a selected club head appearance such as, for example, a specularly reflective polished appearance, or other appearance. The striking plate 130 may also include a set of scorelines, such as exemplary scorelines 135, 136 formed in the striking surface 132.

Figure 4:
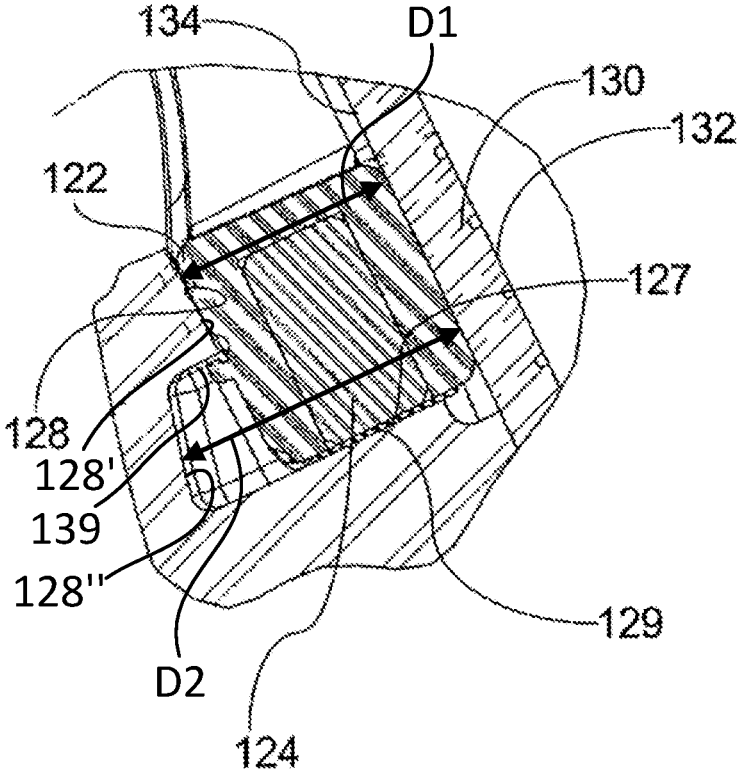
FIG. 4 is an additional sectional view of the golf club head of FIG. 1 illustrating contact of the cartridge insert with a rear surface of a striking plate.

The head body 110 includes a sole cavity 126 formed in proximity to a sole portion of the head body 110 and configured to receive a cartridge assembly 120. The sole cavity 126 is defined in part by a sole-facing surface 127 and a rear cavity surface 128. The sole cavity 126 is configured so that at least a portion of a surface of the cartridge assembly 120 contacts the rear surface 134 of the striking plate 130 when a cartridge assembly 120 is inserted into the sole cavity 126. Typically, the cartridge assembly 120 contacts at least some portions of the sole-facing surface 127 and the rear cavity surface 128, and is secured to the sole-facing surface 127. Referring to FIG. 4, in some examples, the rear cavity surface 128 is divided into an upper rear cavity surface 128' and a lower rear cavity surface 128". The upper rear cavity surface 128' is separated from the lower rear cavity surface 128" by a ledge overhang surface 139. The upper rear cavity surface 128', the lower rear cavity surface 128", and the ledge overhang surface 139 are defined by a rearward sole wall of the sole portion of the head body that extends toward the top-line portion of the head body. The upper rear cavity surface 128' and/or the lower rear cavity surface 128" can be parallel to the substantially planar striking surface 132, and the ledge overhang surface 139 can be perpendicular to the upper rear cavity surface 128', the lower rear cavity surface 128", and/or the substantially planer striking surface 132. Moreover, the upper rear cavity surface 128' is separated from the substantially planar striking surface 132 by a first distance D1 and the lower rear cavity surface 128" is separated from the substantially planar striking surface 132 by a second distance D2. The second distance D2 is greater than the first distance D1. According to some examples, as shown in FIG. 4, the sole cavity 126 and the cartridge assembly 120 are configured such that when the cartridge assembly 120 is inserted into the sole cavity 126, a portion of an elastomer material of the cartridge assembly 120 contacts the upper rear cavity surface 128', the sole-facing surface 127 (e.g., bottom cavity surface), and the ledge overhang surface 139, while no portion of the elastomer material of the cartridge assembly 120 contacts at least a portion of the lower rear cavity surface 128". Accordingly, in some examples, the cartridge assembly 120, including an elastomeric material of the cartridge assembly 120, is not in contact with or is spaced apart from at least a portion of the lower rear cavity surface 128" such that a gap exists between the portion of the lower rear cavity surface 128" and the cartridge assembly 120. In certain examples, no portion of the lower rear cavity surface 128" is in contact with the cartridge assembly 120. Additionally referring to FIG. 4, a sole thickness is measured parallel to the striking surface from the bottom cavity surface to the exterior of the sole portion, and within an imaginary vertical section perpendicular to a hosel axis the sole thickness varies with a minimum thickness located closer to the striking surface than the rearward sole wall.

As described above, the striking plate 130 and the head body 110 may be formed separately. However, alternative manufacturing processes can also be used. For example, the head body 110 and the striking plate 130 can be formed as one piece using various forging, casting, and molding processes as are commonly practiced by golf club head manufacturers. Where the head body 110 and the striking plate 130 are formed as one piece, the substantially planar striking surface 132 is defined by the one piece club head.

In one embodiment, the cartridge assembly 120 includes a cartridge body 122 that is configured to receive one or more cartridge inserts 124. Typically the cartridge body 122 is provided with one or more cylindrical bores or other cavities that retain the cartridge inserts 124. Generally the cartridge body 122 has a modulus of elasticity that is lower than that of the cartridge inserts 124.

Some examples of materials that can be used to form the cartridge body 122 include, without limitation, viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, Isoplast® from The Dow Chemical Company, and Legetolex™ from Piqua Technologies, Inc. In one embodiment the cartridge body 122 may be formed from a material having a modulus of elasticity ranging from about 0.001 GPa to about 25 GPa, and a durometer ranging from about 10 to about 30 on a Shore D scale. In a preferred embodiment the cartridge body 122 may be formed from a material having a modulus of elasticity ranging from about 0.001 GPa to about 10 GPa, and a durometer ranging from about 15 to about 25 on a Shore D scale. In a most preferred embodiment the cartridge body 122 may be formed from a material having a modulus of elasticity ranging from about 0.001 GPa to about 5 GPa, and a durometer ranging from about 18 to about 22 on a Shore D scale. In some examples, a material providing vibration damping is preferred.

As shown in FIGS. 1-4, the cartridge inserts 124 are typically formed of relatively dense materials that permit a center of gravity of a club head to be low and rearward of the striking surface 132. Some examples of materials that can be used to form the cartridge inserts 124 include, without limitation, steel alloys, tungsten and tungsten alloys, other metals and metal alloys, or other materials. Typical densities of such materials are preferably greater than about 2.5 g/cm$^3$ or 5.0 g/cm$^3$. In some preferred examples, insert densities are at least about 15 g/cm$^3$.

In order to provide selected mass, mass distribution, and/or vibration dampening characteristics, in some examples the cartridge body 122 can be provided with an additional loading material as spheres, rods, fibers or other particles that are distributed throughout the cartridge body 122. In other examples, the cartridge body 122 may comprise two or more sections of different materials that are configured to provide such benefits. In yet other examples, the cartridge assembly 120 may be formed without cartridge inserts 124, and fiber or particulate loading material may be distributed throughout the cartridge body 122 to achieve desirable mass distribution and/or vibration dampening characteristics. The fiber or particulate loading material may be formed from materials such as those listed above with respect to the cartridge inserts 124. Other cartridge body 122 configurations may include a laminar structure comprising alternating layers of materials having varying modulus of elasticity values.

The cartridge assembly 120 can be conveniently secured to the sole cavity 126 in the club head 100 with a tape strip 129, other adhesive, or otherwise secured or retained in the sole cavity 126. Cartridge inserts 124 can be cylindrical or other shapes, or can be omitted based on the dimensions and density of the cartridge body 122. A badge 125 can be applied to the head body 110, to control mass distribution, for ornamentation, club identification, or other purposes. As shown in FIGS. 3-4, the cartridge body 122, as retained by the head body 110, is configured to contact the rear surface 134 of the striking plate 130 in a cartridge contact area.

Referring to FIG. 3, the rear surface 134 of the striking plate 130 is opposite the striking surface 132 and faces the cavity 118. For an iron manufactured using pull face construction, a perimeter portion 138 of striking plate 130 contacts the head body 110 at the front rim 119. A striking plate rear cavity region is defined as the portion of the striking plate rear surface 134 that is exposed to the cavity 118. Consequently, for an iron manufactured using pull face construction, the portions of the striking plate rear surface 134 supported by the front rim 119 are not included within the striking plate rear cavity region.

The surface area of the striking surface 132 (i.e., the surface area of the substantially planar surface defined by the striking plate 130 and the perimeter portion 138) can be selected based on, for example, club type, striking surface shape, and whether or not the club is to be a so-called "oversized" club. The thickness of the striking plate 130 is defined as the distance between a selected point on the striking face 132 and the rear surface 134 along an axis perpendicular to the striking face 132. The striking plate thickness can be selected to reduce mass associated with the striking plate 130, so that additional mass can be distributed to other parts of the club head 100 to achieve intended club design goals. Typically, striking plate thickness is selected consistent with long term club use to avoid premature striking plate failure due to fatigue cracking and other such failure modes. Typically, redistributed mass is situated low on the club head 100 and rearward of the striking plate 130.

Some examples of materials that can be used to form the striking plate and the head body include, without limitation, carbon steels (e.g., 1020 or 8620 carbon steel), stainless steels (e.g., 304, 410, or 431 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, nickel alloys, glass fiber reinforced polymers (GFRP), carbon fiber reinforced polymers (CFRP), metal matrix composites (MMC), ceramic matrix composites (CMC), and natural composites (e.g., wood composites). High strength materials having a relatively high modulus of elasticity (typically greater than about 50 GPa, 100 GPa, 150 GPa, 200 GPa, or 250 GPa) are generally preferred. In use, the striking plate 130 is subject to numerous high speed impacts with a golf ball, and should resist cracking and permanent deformation. Different types of irons (e.g., long irons and short irons) can experience different forces in golf ball impacts, and striking plate thickness can be adjusted accordingly, if desired.

Figure 5A:
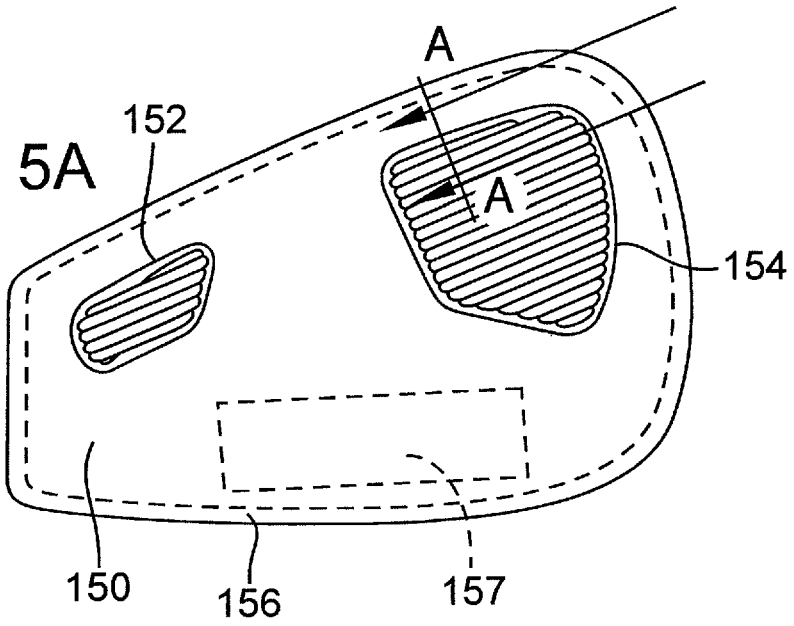
FIGS. 5A-5B are views of rear surfaces of representative striking plates.
Figure 5B:
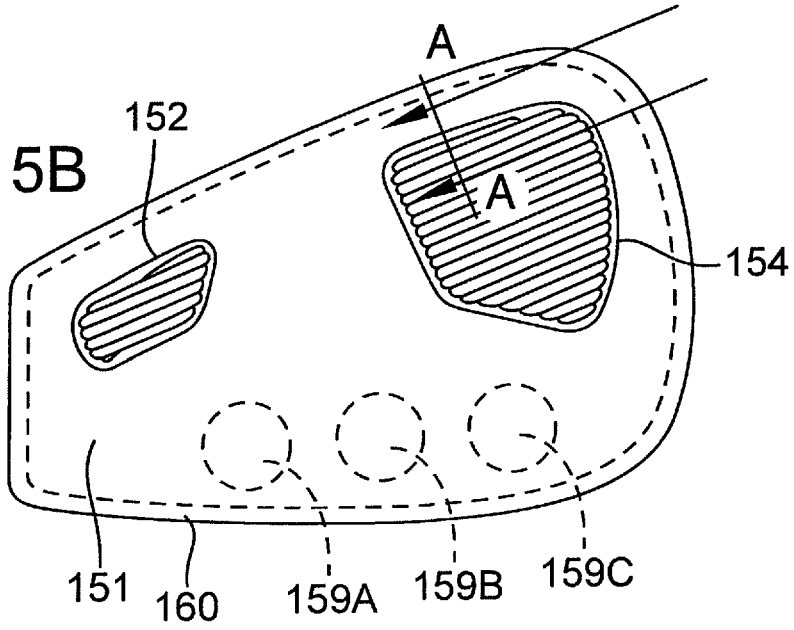
Figure 5C:
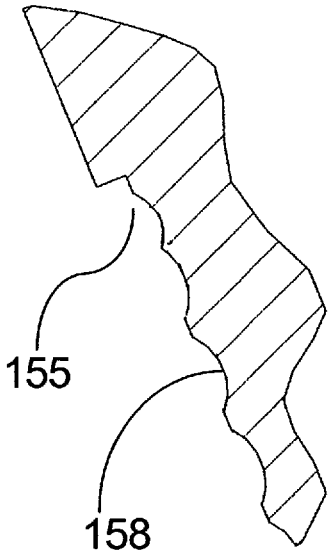
FIG. 5C is a sectional view of the striking plate of FIG. 5A illustrating a control feature defined on the rear surface of the striking plate.

FIGS. 5A-5B illustrate control features 152, 154 situated on rear surfaces (i.e., surfaces opposite a striking surface) of representative striking plates 150, 151. Referring to FIG. 5C, the control feature 154 is defined by a recess 155 in the rear surface that is provided with a plurality of grooves such as a representative groove 158. Control features can be adjusted to provide a selected club playing characteristic, typically to provide an intended sound when striking a golf ball. FIGS. 5A-5B also illustrate representative striking plate areas in which a cartridge assembly such as the cartridge assembly 120 or other cartridges or cartridge assemblies contacts a rear surface of a striking plate. For example, as shown in FIG. 5A, the striking plate 150 contacts a cartridge assembly in a cartridge contact area 157 situated on the rear surface of the striking plate 150. In another representative example shown in FIG. 5B, the striking plate 151 contacts a cartridge assembly in surface area portions 159A, 159B, 159C.

Striking plate dimensions can vary based on striking plate composition and preferred club head dimensions. Larger or smaller striking surfaces can be provided for "short" or "long" irons, if desired. Typically, cavity-back club head designs such as the example of FIGS. 1-4 include a thin striking plate so that striking plate mass is reduced and redistributed to the club head perimeter. All or a portion of the rear surface 134 of the striking plate 130 within the striking plate rear cavity region may be unsupported by the clubhead body such that the striking plate deforms upon impact with a golf ball.

In some embodiments, a cartridge or cartridge assembly may be configured to contact a portion of the rear surface 134 of the striking plate 130 in a secondary support area, or cartridge contact area. In this way, the cartridge allows for a thinner striking plate because of the additional support the cartridge provides to the striking plate. As used herein, portions of a striking plate or other striking member of a golf club that lack a backing support structure (e.g., a cartridge or cartridge assembly) having a modulus of elasticity greater than about 25 GPa are referred to as unsupported. Consequently, an unsupported striking plate area may be defined as the portion of the striking plate rear cavity region lacking a backing support structure having a modulus of elasticity greater than about 25 GPa, or equivalently the surface area of the striking plate rear cavity region minus the cartridge contact area. Striking plate dimensions, surface area of the striking plate rear cavity region, unsupported striking plate surface area, striking plate thickness, and cartridge contact area can be selected based on a desired mass distribution, club durability, striking plate materials, and other design goals.

As used herein, a contact area of an elastomeric portion of a cartridge with a rear surface of a striking plate is referred to as a secondary support area, or cartridge contact area. As noted above, the cartridge body may be formed from an elastomeric material having a modulus of elasticity ranging from about 0.001 to about 25 GPa. Providing such a secondary support area with elastomeric materials permits mass reduction in the striking plate with no decrease in striking plate durability. In order to maintain a large striking surface, such mass reduction can be conveniently associated with a relatively thin striking plate. In a typical example, a stainless steel striking plate (modulus of about 200 GPa) having an unsupported striking plate area of about 2000 $mm^2$ has an average thickness of about 1.9 mm and a cartridge contact area of about 400 $mm^2$. Details for several representative examples are set forth in the table below.

While FIGS. 1-4 illustrate a representative cavity back iron of pull face construction, in other examples cavity back irons are configured based on one piece (i.e., unitary) construction using manufacturing methodologies such as forging or casting. In one piece construction, a striking plate portion can be formed integrally with a club body, and defines a front striking surface and a rear surface opposite the front striking surface of the striking plate portion. In one piece construction, a striking plate thickness is defined as the distance between a selected point on the striking surface 132 and the rear surface 134 along an axis perpendicular to the striking surface 132. Generally in the case of a cavity back iron of unitary construction, the rear surface 134 of the striking plate 130 may gradually or abruptly transition from a relatively thin striking face thickness to a much thicker perimeter weighting region. In this case the striking plate rear cavity region is delineated by and includes a peripheral region having a striking plate thickness less than or equal to about 2.2 mm, which is bounded by a thicker perimeter weighting region having a thickness greater than about 2.2 mm. Typically, the maximum thickness of the perimeter weighting region is at least as thick as about 4.5 or 6 times the thickness of the thinnest portion of the striking plate rear cavity region.

Figure 6:
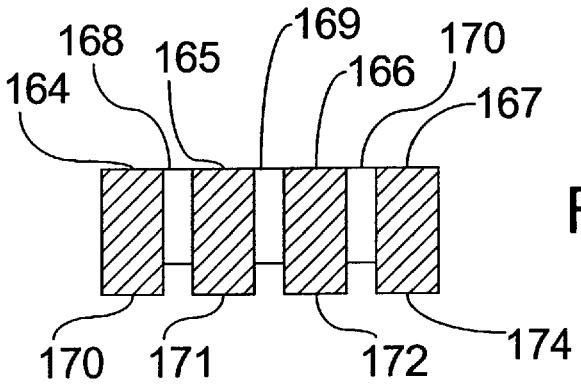
FIG. 6 illustrates an additional example of a cartridge configured for placement in a head body of an iron type golf club.

An additional cartridge example is illustrated in FIG. 6. Referring to FIG. 6, a cartridge 162 includes alternating elastomeric sections 164 and insert sections 166. The elastomeric sections are selected from materials having a relatively low modulus of elasticity, typically less than about 25 GPa, less than about 10 GPa, less than about 5 GPa, or less than about 1 GPa. The insert sections 166 are generally formed of stiffer, denser materials than the elastomeric sections. The modulus of elasticity for such sections is typically greater than about 10 GPa, 50 GPa, or 100 GPa. The cartridge 162 includes a contact surface configured to contact a striking plate rear surface 134, where the contact surface is defined by surfaces 170-174 of the insert sections. While the cartridge of FIG. 6 illustrates sections alternating horizontally, in other examples, the sections can alternate vertically and fewer or more sections can be provided. In addition, the insert and elastomeric section alternation can be periodic in some examples, but generally need not be. In other examples, the elastomeric sections can be denser and/or stiffer than the insert sections, and the insert sections configured to contact a striking plate rear surface. Sections can have rectangular, square, or other cross sections.

Striking plates of pull face construction irons or striking plate portions of one piece cast or forged irons can be conveniently described based on a characteristic thickness ratio that is defined as a ratio of the average striking plate thickness within the striking plate rear cavity region and a square root of the unsupported striking plate area (i.e., the portion of the striking plate rear cavity region lacking a backing support structure having a modulus of elasticity greater than about 25 GPa). In addition, a portion of an unsupported striking plate area in contact with the cartridge can be described by a relative cartridge contact area ratio defined as a ratio of the cartridge contact area and unsupported striking plate area.

In typical examples, unsupported striking plate areas range from about 1500 $mm^2$ to about 3000 $mm^2$, average striking plate thickness within the striking plate rear cavity region range from about 1.5 mm to about 2.2 mm, and cartridge contact areas range from about 300 $mm^2$ to about 400 $mm^2$. Consequently, characteristic thickness ratios may range from about 2% to about 4.8% and relative cartridge contact area ratios may range from about 10% to about 25%, or preferably from about 10% to about 18%. Such club head parameters can vary depending on club head geometry as affected by material properties such as, for example, a modulus of elasticity of striking plate material. Parameters can also be selected based on whether a particular club head is to be a short iron, a mid iron, or a long iron.

Club head geometries for three representative club set configurations A, B, and C are described in Table 1 below. For each of the three sets, representative values for a 3 iron, a 6 iron, and a 9 iron are listed. Tabulated values are unsupported striking plate area (USPA), average striking plate thickness (ASPT), cartridge contact area (CCA), characteristic thickness ratio (CTR), and relative cartridge contact area ratio (RCAR). The representative club set heads may be manufactured from discrete components using, for example, pull face construction methods, or the representative club set heads may be manufactured as unitary components using, for example, various casting or forging techniques.

TABLE 1

Representative club head geometries

| Set and Club | USPA ($mm^2$) | ASPT (mm) | CCA ($mm^2$) | CTR (%) | RCAR (%) |
|---|---|---|---|---|---|
| A-3 | 2062 | 1.8 | 304 | 4.0 | 14.7 |
| A-6 | 2062 | 1.8 | 304 | 4.0 | 14.7 |
| A-9 | 1898 | 1.8 | 304 | 4.1 | 16.0 |
| B-3 | 1701 | 1.9 | 387 | 4.6 | 22.8 |
| B-6 | 1714 | 1.9 | 387 | 4.6 | 22.6 |
| B-9 | 1898 | 1.9 | 387 | 4.4 | 20.4 |
| C-3 | 2112 | 2.1 | 393 | 4.6 | 18.6 |
| C-6 | 2310 | 2.1 | 393 | 4.4 | 17.0 |
| C-9 | 2211 | 2.1 | 393 | 4.5 | 17.8 |

The tabulated values are representative, and other configurations can be provided as described above. Cartridges can be configured to provide secondary support areas of various shapes and sizes, and situated at club locations based on, for example, an intended mass distribution. Unsupported striking plate surfaces may be of constant thickness, continuously variable thickness, stepped thickness, or combinations thereof. In some examples, only portions of an elastomeric surface of a cartridge contacts the rear surface of a striking plate or other striking portion.

Striking plates of pull face construction cavity back irons or striking plate portions of one piece cast or forged cavity back irons may also be described based on an unsupported area ratio that is defined as a ratio of the unsupported striking plate area and the area of the substantially planar striking surface 132. Club head geometries for two representative club set configurations D and E are described in Table 2 below. For club set configuration D, representative values for 4, 5, 6, 7, 8, and 9 irons are listed. For club set configuration E, representative values for 5, 6, 7, 8, and 9 irons are listed. Tabulated values are loft angle (L), striking surface area (SSA), unsupported striking plate area (USPA), and unsupported area ratio (UAR). As above, the representative iron heads may be manufactured from discrete components using, for example, pull face construction methods, or the representative club set heads may be manufactured as unitary components using, for example, various casting or forging techniques.

TABLE 2

Representative club head geometries.

| Set and Club | L (degrees) | SSA ($mm^2$) | USPA ($mm^2$) | UAR (%) |
|---|---|---|---|---|
| D-4 | 20 | 3167 | 2599 | 82.1 |
| D-5 | 23 | 3207 | 2613 | 81.5 |
| D-6 | 26 | 3264 | 2671 | 81.8 |
| D-7 | 30 | 3314 | 2697 | 81.4 |
| D-8 | 34 | 3366 | 2730 | 81.1 |
| D-9 | 39 | 3442 | 2805 | 81.3 |
| E-5 | 22 | 3214 | 2572 | 80.0 |
| E-6 | 25 | 3265 | 2628 | 80.4 |
| E-7 | 28 | 3318 | 2653 | 80.0 |
| E-8 | 32 | 3366 | 2743 | 81.5 |
| E-9 | 37 | 3447 | 2796 | 81.5 |

For each of the exemplary club heads listed in Table 2, the striking surface area SSA is related to the loft angle L by the following equation:

$$SSA \geq 14.4(L)+2875,$$

wherein SSA is the striking surface area measured in square-millimeters and L is the loft angle measured in degrees. In other examples, areas and angles can be expressed in different units with corresponding changes in any numerical constants in the equation. This relationship provides for increased striking face surface area for a given loft angle compared to traditional cavity back iron club heads. Additionally, the unsupported area ratio for each of the club heads listed in Table 2 is greater than or equal to 80%. In alternative embodiments of the invention, the unsupported area ratio may range from about 80% to about 88%, and in preferred embodiments of the invention, the unsupported area ratio may range from about 83% to about 88%.

The loft angle of an exemplary cavity back 4-iron may range from about 19 degrees to about 21 degrees, preferably from about 19.5 degrees to about 20.5 degrees; the striking surface area may range from about 3156 $mm^2$ to about 3487 $mm^2$, preferably from about 3322 $mm^2$ to about 3487 $mm^2$; and the unsupported striking plate ratio is greater than or equal to 80%, preferably about 83% to about 88%; The loft angle of an exemplary cavity back 5-iron may range from about 21.5 degrees to about 22.5 degrees, preferably from about 22 degrees to about 23 degrees; the striking surface area may range from about 3185 $mm^2$ to about 3519 $mm^2$, preferably from about 3352 $mm^2$ to about 3519 $mm^2$; and the unsupported striking plate ratio is greater than or equal to 80%, preferably about 83% to about 88%. The loft angle of an exemplary cavity back 6-iron may range from about 24.5 degrees to about 26.5 degrees, preferably from about 25 degrees to about 26 degrees; the striking surface area may range from about 3228 $mm^2$ to about 3582 $mm^2$, preferably from about 3405 $mm^2$ to about 3582 $mm^2$; and the unsupported striking plate ratio is greater than or equal to 80%, preferably about 83% to about 88%. The loft angle of an exemplary cavity back 7-iron may range from about 27.5 degrees to about 30.5 degrees, preferably from about 28 degrees to about 30 degrees; the striking surface area may range from about 3271 $mm^2$ to about 3646 $mm^2$, preferably from about 3458 $mm^2$ to about 3646 $mm^2$; and the unsupported striking plate ratio is greater than or equal to 80%, preferably about 83% to about 88%. The loft angle of an exemplary cavity back 8-iron may range from about 31.5 degrees to about 34.5 degrees, preferably from about 32 degrees to about 34 degrees; the striking surface area may range from about 3329 $mm^2$ to about 3709 $mm^2$, preferably from about 3519 $mm^2$ to about 3709 $mm^2$; and the unsupported striking plate ratio is greater than or equal to 80%, preferably about 83% to about 88%. The loft angle of an exemplary cavity back 9-iron may range from about 36.5 degrees to about 39.5 degrees, preferably from about 36 degrees to about 39 degrees; the striking surface area may range from about 3401 $mm^2$ to about 3788 $mm^2$, preferably from about 3594 $mm^2$ to about 3788 $mm^2$; and the unsupported striking plate ratio is greater than or equal to 80%, preferably about 83% to about 88%.

Figure 7A:
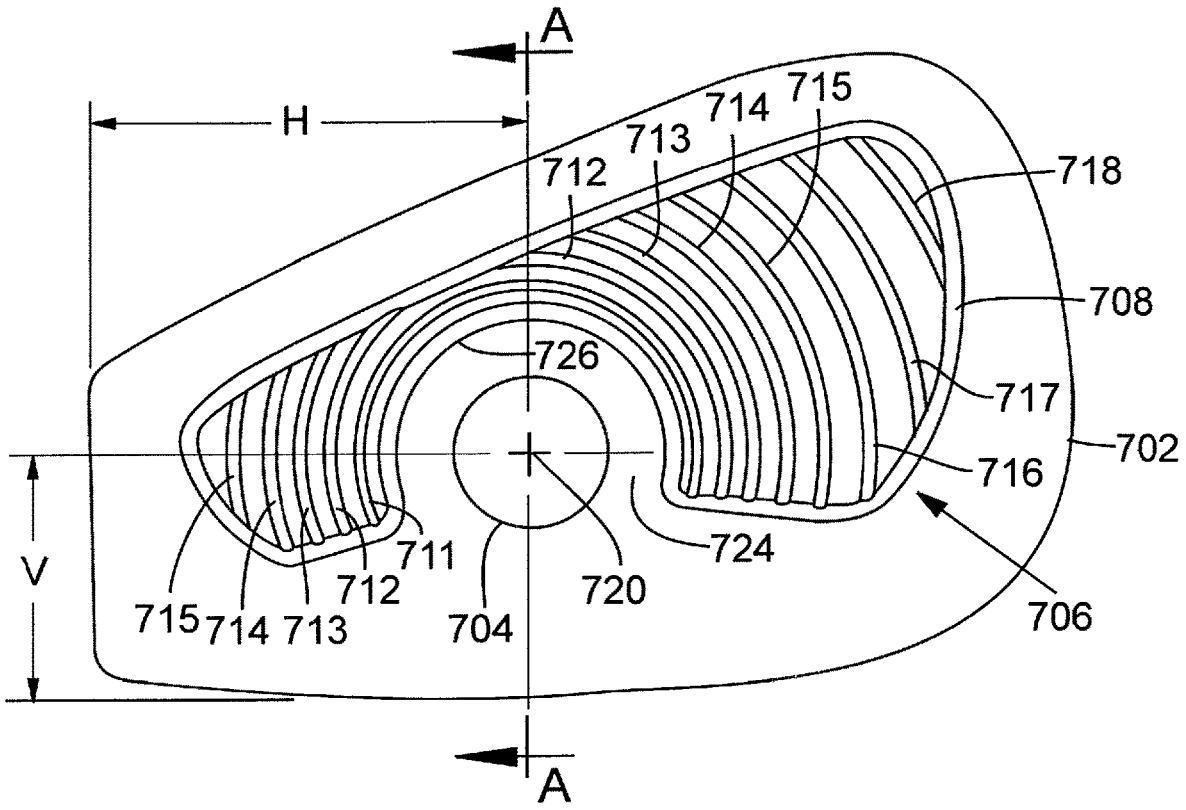
FIGS. 7A-7B illustrate a variable thickness striking plate that includes a thinned circular striking zone.
Figure 7B:
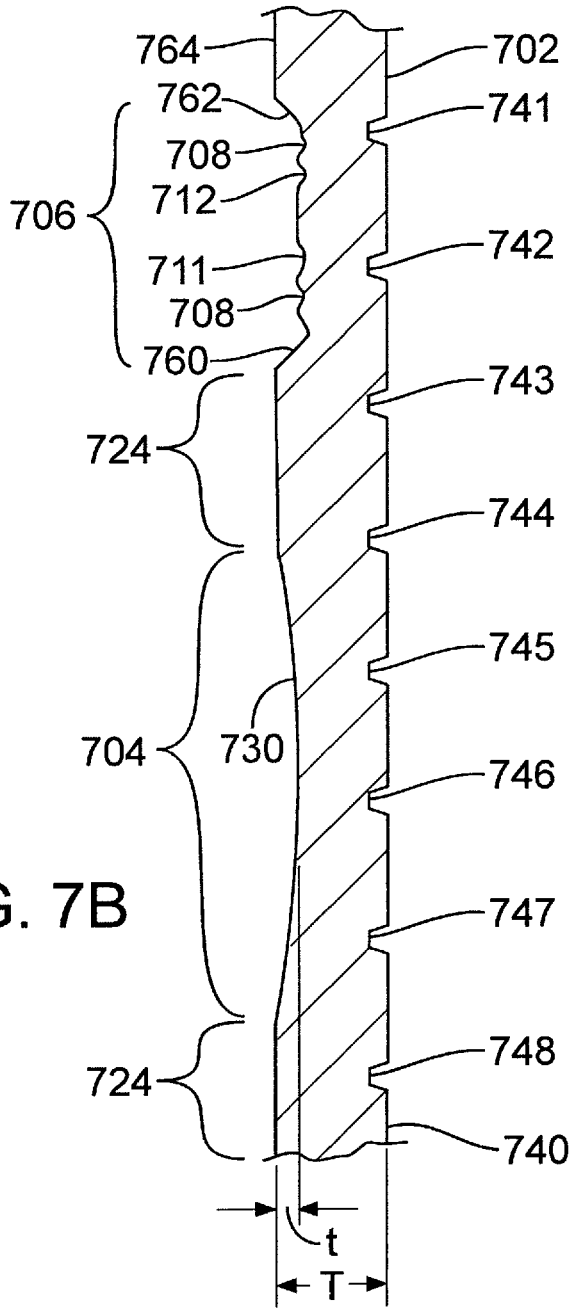

Striking plates can be thinned substantially uniformly or selected locations on a striking plate can be thinned or otherwise shaped so as to provide a redistribution of mass, a desired "feel" when used, and/or a preferred "sweet spot" size or location. Referring to FIGS. 7A-7B, a striking plate 702 includes a thinned striking region 704 and a relief region 706 that is defined by a perimeter groove 708. The relief region 706 includes a plurality of circumferential grooves 711-718 that are typically defined along circular arcs that are approximately centered about a center 720 of the striking region 704. As shown in FIGS. 7A-7B, the striking plate also includes a face region 724 that has a substantially constant thickness. In some examples, grooves can be defined by elliptical, parabolic, hyperbolic or other curved arcs, or by straight line segments, or combinations thereof and situated about a geometric center of a striking region, a focus of a conic section, or otherwise situated. In the example of FIG. 7A, at least some of the grooves 711-718 include a first segment and a second segment that are disconnected. For example, the grooves 712-714 are discontinuous and include first and second segments that are separated by a portion of the face region 724. In the example of FIG. 7A, the thinned striking region 704 is circular and has a diameter of about 11.7 mm. A central edge 726 of the relief region 706 extends along a portion of a circular arc having a radius of 10.4 mm centered about the striking region 704.

As shown in FIG. 7B, the striking plate 702 has a thickness T=2.2 mm and is relieved by a thickness t=0.5 mm at a thinnest portion corresponding to the center 720 of the striking region 704 to have a central thickness of about 1.7 mm. A surface 730 of the region 704 can be defined as, for example, a portion of a spherical surface. In one example, a radius of a spherical surface associated with a 0.5 mm decrease in thickness at the center 720 of a 11.7 mm diameter striking region 704 is about 34.5 mm. A striking surface 740 is provided with a plurality of scorelines 741-748. The relief region 706 also includes transition segments 760, 762 that couple the relief region 706 and the support region 724. In the example of FIG. 7B, surfaces of the transition regions 760, 762 are situated at about 45 degrees with respect to a surface 764 of the support region 724. As shown in the example of FIGS. 7A-7B, a thickness of the striking plate 702 in the relief region 706 is about 1.6 mm, and the grooves 708, 711-718 extend a distance of about 0.15 mm into the striking plate 702 and have radii of curvature of about 0.5 mm. More or fewer grooves can be provided in the relief zone, and relief zones that have larger areas or depths can be used.

Horizontal (H) and vertical (V) locations of the center of a striking zone for a representative iron set are included in Table 3. For convenience, approximate striking plate mass is provided for each club.

TABLE 3

Representative Striking Plate Specifications

| Club | Mass (g) | H (mm) | V(mm) |
|---|---|---|---|
| 3 iron | 30.7 | 37.2 | 19.6 |
| 4 iron | 31.2 | 37.2 | 19.9 |
| 5 iron | 31.7 | 37.2 | 20.4 |
| 6 iron | 33.1 | 37.2 | 21.6 |
| 7 iron | 33.3 | 37.4 | 22.0 |
| 8 iron | 34.0 | 37.4 | 22.1 |
| 9 iron | 34.6 | 37.4 | 24.3 |
| P wedge | 35.3 | 37.3 | 26.0 |
| A wedge | 35.5 | 37.3 | 28.2 |
| S wedge | 36.4 | 37.0 | 28.6 |

Figure 8A:
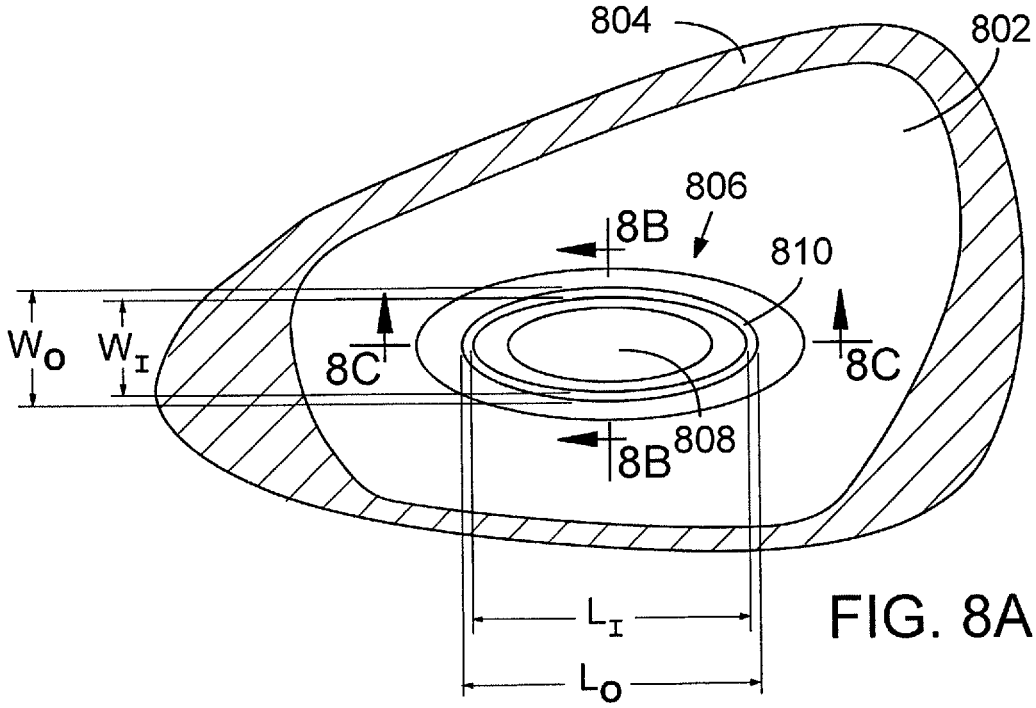
FIGS. 8A-8C illustrate a club head that includes a variable thickness striking plate having an oval striking area.
Figure 8B:
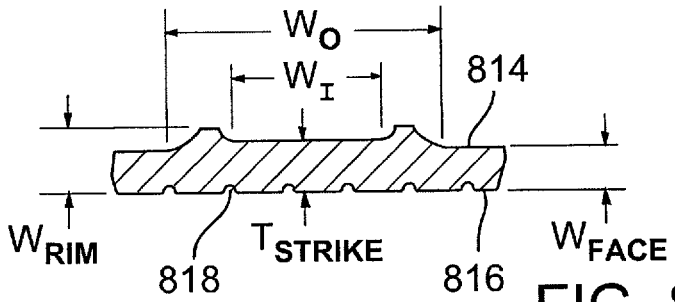
Figure 8C:
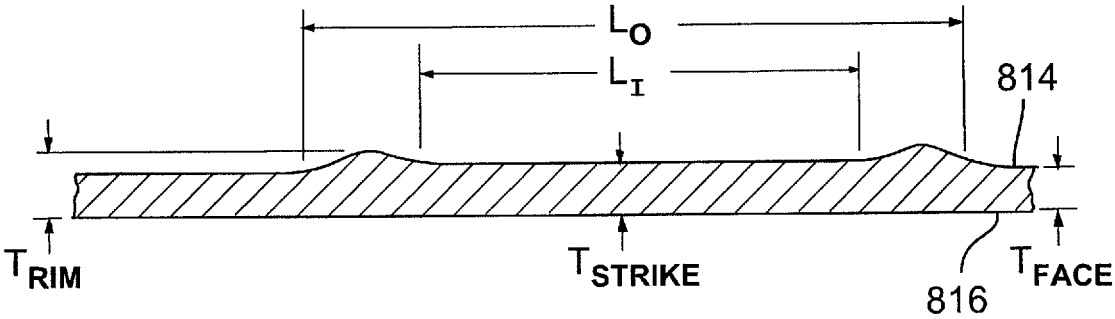

An additional exemplary striking plate 802 retained in a head body 804 is illustrated in FIGS. 8A-8C. The striking plate 802 has a thickness $T_{FACE}$ and includes an oval support area 806 having a central oval area 810 of thickness $T_{STRIKE}$ and a rim 812 of thickness $T_{RIM}$ that are provided on a rear surface 814. The rim 812 defines an oval rim region having interior and exterior lengths $L_I$, $L_O$, respectively and interior and exterior widths $W_I$, $W_O$, respectively. The rim 812 has an annular width of between about 0.9 mm and 1.5 mm at the thickest portion, and dimensions of the rim region are based on locations at which the striking plate thickness is substantially the same as the thicknesses associated with the striking region and the face region. A front surface (a striking surface) 816 of the striking plate 802 includes a plurality of grooves 818. In some examples, the oval support area 806 is elliptical and lengths and widths correspond to major and minor axes of ellipses. A bottom edge 817 of a sole 816 typically extends parallel to the ground (and rests on the ground) when the club is positioned so as to address a ball. Typically a long axis of the oval support area 806 extend approximately parallel to the bottom edge 817. In the example of FIGS. 8A-8C, a striking face area is somewhat thicker than the remainder of the striking plate. Dimensions of representative striking plates and associated oval support areas such as illustrated in FIGS. 8A-8C are listed in Table 4.

TABLE 4

Representative Striking Plate Dimensions

| | Example 1 | Example 2 | Example 3 | Example 4 | Example 5 |
|---|---|---|---|---|---|
| $T_{FACE}$ (mm) | 1.9-2.2 | 1.9-2.2 | 1.9-2.2 | 1.9-2.2 | 1.9-2.2 |
| $T_{STRIKE}$ (mm) | 2.7-2.9 | 2.4-2.6 | 2.2-2.9 | 2.4-2.7 | 2.5-2.6 |
| $T_{RIM}$ (mm) | 3.4-3.8 | 2.9-3.2 | 2.9-3.6 | 3.1-3.4 | 3.2-3.3 |
| Striking Face Area ($mm^2$) | 2825-3113 | 2793-3152 | 2800-3200 | 2800-3200 | 2800-3200 |
| Oval Area ($mm^2$) | 502-554 | 370-408 | 390-580 | 450-550 | 500-550 |
| $L_O$ (mm) | 39.9-44.1 | 34.2-37.8 | 32-46 | 36-44 | 38-42 |
| $W_O$ (mm) | 15.2-16.8 | 13.1-14.5 | 11-19 | 13-17 | 15.5-16.5 |
| $L_I$ (mm) | 20.9-23.1 | 17.1-18.9 | 15-25 | 18-22 | 19-21 |
| $W_I$ (mm) | 7.6-8.4 | 6.5-7.2 | 6-9 | 7-8.5 | 7.75-8.25 |

The striking plate examples shown in FIGS. 7A-7B and 8A-8C may be provided on a club head using pull face construction or unitary construction techniques. A variety of other striking plates can be similarly arranged to include thinned or thickened striking regions, relief regions, or other features described above.

The representative clubs, components thereof, and related assembly and manufacturing methods presented above are examples only and are not to be taken as limiting. As disclosed above, striking plates used in pull face club construction or other club faces can be thinned or thickened to permit improved mass redistribution. In some examples, portion of a thinned striking plate are supported or contacted by a weight cartridge, while other examples, a central or interior portion of a striking plate is thinner or thicker than a surrounding portion. Thickness changes can be abrupt or gradual, and tapered thinned or thickened face plates can be used. Portions of the striking plate can be grooved or otherwise relieved so that the associated mass can be situated as desired to provide an intended playing characteristic. These examples are presented for convenient explanation, and are not to be taken as limiting the scope of the appended claims. We claim all that is encompassed by the appended claims.

We claim:

1. An iron-type golf club head comprising:

a head body including a hosel, a heel portion, a toe portion, a top-line portion, a sole portion including a rearward sole wall extending toward the top-line portion and defining a rear cavity surface having an upper rear cavity surface separated from a lower rear cavity surface by a ledge overhang surface, and a rear cavity, wherein the rear cavity is surrounded in part by the heel portion, the sole portion, the toe portion, the top-line portion, and at least a portion of the rear cavity surface;

a striking plate welded to the head body and defining at least a portion of an iron-type face, the striking plate having a substantially planar striking surface and a rear surface defining a thickness therebetween, wherein the upper rear cavity surface is separated from the substantially planar striking surface by a first distance, and the lower rear cavity surface is separated from the substantially planar striking surface by a second distance that is greater than the first distance;

wherein the rear cavity is at least partially defined by a bottom cavity surface, the upper a rear cavity surface, the lower rear cavity surface, the ledge overhang surface, a heel side surface, and a toe side surface;

wherein the rear cavity is configured so that at least a portion of a surface of an elastomer material contacts the rear surface of the striking plate when the elastomer material is inserted into the rear cavity;

wherein the elastomer material at least partially fills the rear cavity, and at least a portion of the elastomer material contacts the upper rear cavity surface, the lower rear cavity surface, the ledge overhang surface, and the bottom cavity surface, and contacts the rear surface of the striking plate at least at a heel side of the striking plate and a toe side of the striking plate;

wherein the elastomer material is located in part between the upper rear cavity surface and rear surface of the striking plate and contacts both the upper rear cavity surface and rear surface;

wherein the elastomer material is located in part between the lower rear cavity surface and rear surface and contacts the rear surface but not the lower rear cavity surface;

wherein the elastomer material has a modulus of elasticity between 0.001 GPa and 10 GPa;

wherein the striking plate is comprised of a first material and the head body is comprised of a second material, wherein the first material and the second material are steel alloys each having a modulus of elasticity greater than 150 GPa; and wherein at least a portion of the ledge overhang surface extends over-top of a portion of the elastomer material, wherein the thickness of the striking plate is variable and varies by at least 0.7 mm and the rear surface of the striking plate having an area ranging from about 1500 $mm^2$ to about 3000 $mm^2$.

2. The iron-type golf club head of claim 1, wherein at least one of the upper rear cavity surface and the lower rear cavity surface is parallel to the substantially planar striking surface, and the ledge overhang surface is perpendicular to at least one of the upper rear cavity surface, the lower rear cavity surface, and the substantially planar striking surface.

3. The iron-type golf club head of claim 1, wherein the iron-type golf club head is a hollow iron type club head.

4. The iron-type golf club head of claim 1, further comprising one or more metal weights positioned below a geometric center of the striking surface, the one or more metal weights being formed of a material having a density greater than the density of the first material, and at least one of the one or more metal weights contacts the elastomer material.

5. The iron-type golf club head of claim 4, wherein the rear surface of the striking plate has an oval support area with a minor axis, having a minor axis length, and a major axis, having a major axis length that is at least 7 mm greater than the minor axis length.

6. The iron-type golf club head of claim 4, wherein the second material comprises a carbon steel and the first material comprises a high strength steel having a modulus of elasticity greater than 200 GPa.

7. The iron-type golf club head of claim 4, wherein a sole thickness is measured parallel to the striking surface from the bottom cavity surface to the exterior of the sole portion, and within an imaginary vertical section perpendicular to a hosel axis the sole thickness varies with a minimum thickness located closer to the striking surface than the rearward sole wall.

8. The iron-type golf club head of claim 7, wherein the elastomer material is a thermoplastic.

9. The iron-type golf club head of claim 4, wherein the elastomer material is a thermoset.

10. The iron-type golf club head of claim 4, wherein the thickness of the striking plate has an average thickness within the substantially planar striking surface ranging from about 1.5 mm to about 2.2 mm.

11. The iron-type golf club head of claim 4, wherein the iron-type golf club head is a cavity back iron type club head.

12. The iron-type golf club head of claim 1, wherein the elastomer material is spaced apart from at least a portion of the lower rear cavity surface such that a gap exists between the at least the portion of the lower rear cavity surface and the elastomer material.

13. An iron-type golf club head comprising:

a first piece defining at least a portion of an iron-type face, the first piece having a rear surface and a striking surface, wherein the distance between the rear surface and the striking surface defining a first piece thickness;

a second piece including a hosel, a heel portion, a sole portion, a toe portion, a top-line portion, a sole portion including a rearward sole wall extending toward the top-line portion and defining a rear cavity surface, wherein at least a portion of the rearward sole wall is recessed rearwardly from a rear cavity forming a recessed portion of the rearward sole wall and defining an upper rear cavity surface separated from a lower rear cavity surface by a ledge overhang surface, wherein the rear cavity is surrounded in part by the heel portion, the sole portion, the toe portion, the top-line portion and at least a portion of the rear cavity surface, wherein the first piece is welded to the second piece, and wherein the upper rear cavity surface is separated from the striking surface by a first distance, and the lower rear cavity surface is separated from the striking surface by a second distance that is greater than the first distance;

one or more metal weights positioned within the rear cavity and below a geometric center of the striking surface;

wherein the one or more metal weights being formed of a material having a density greater than the density of the first piece and the first piece comprising a steel alloy;

wherein the rear cavity is formed in proximity to the sole portion, and the rear cavity is at least partially defined by a bottom cavity surface, the upper rear cavity surface, the lower rear cavity surface, the ledge overhang surface, a heel side surface, and a toe side surface;

wherein the rear cavity is configured so that at least a portion of a surface of an elastomer material contacts the rear surface of the striking plate when the elastomer material is inserted into the rear cavity;

wherein the elastomer material at least partially fills the rear cavity, and at least a portion of the elastomer material contacts the upper rear cavity surface, the lower rear cavity surface, the ledge overhang surface, and the bottom cavity surface, and contacts the rear surface of the first piece at least at a heel side of the first piece and a toe side of the first piece;

wherein the elastomer material is located in part between the upper rear cavity surface and rear surface of the striking plate and contacts both the upper rear cavity surface and rear surface;

wherein the elastomer material is located in part between the lower rear cavity surface and rear surface and contacts the rear surface but not the lower rear cavity surface;

wherein the rear surface of the first piece having an area ranging from about 1500 $mm^2$ to about 3000 $mm^2$;

wherein the elastomer material provides vibration dampening and has a modulus of elasticity between 0.001 GPa and 25 GPa; and wherein the first piece is comprised of a first material and the second piece is comprised of a second material, wherein the first material and the second material are steel alloys each having a modulus of elasticity greater than 150 GPa.

14. The iron-type golf club head of claim 13, wherein at least a portion of the elastomer material has a front to back dimension that is greater than the first piece thickness, and at least a portion of the elastomer material extends into the recessed, portion of the rearward sole wall.

15. The iron-type golf club head of claim 14, wherein the elastomer material contacts at least one of one or more metal weights and the first piece thickness is variable and varies by at least 0.7 mm.

16. The iron-type golf club head of claim 15, wherein the iron-type golf club head is a hollow iron type club head.

17. The iron-type golf club head of claim 15, wherein the iron-type golf club head is a cavity back iron type club head.

18. The iron-type golf club head of claim 13, wherein the elastomer material is spaced apart from at least a portion of the lower rear cavity surface such that a gap exists between the at least the portion of the lower rear cavity surface and the elastomer material.

* * * * *